US007784624B1

(12) United States Patent
Pinto

(10) Patent No.: US 7,784,624 B1
(45) Date of Patent: Aug. 31, 2010

(54) COLLAPSIBLE BASEBALL EQUIPMENT HANGAR APPARATUS

(76) Inventor: Julio A. Pinto, 11990 SW. 92nd St., Miami, FL (US) 33186

( * ) Notice: Subject to any disclaimer, the term of this patent is extended or adjusted under 35 U.S.C. 154(b) by 413 days.

(21) Appl. No.: 11/963,967

(22) Filed: Dec. 24, 2007

(51) Int. Cl.
*A47F 7/00* (2006.01)

(52) U.S. Cl. ..... 211/85.7

(58) Field of Classification Search ..... 211/85.7, 211/113, 149, 195, 85; 108/134, 135, 44, 108/60, 42; 220/4.29, 4.28, 6; 206/600, 206/315.1; 248/460
See application file for complete search history.

(56) References Cited

U.S. PATENT DOCUMENTS

| | | | | | |
|---|---|---|---|---|---|
| 4,193,495 | A | * | 3/1980 | Keeley | 294/143 |
| 4,323,250 | A | * | 4/1982 | Lansberry | 273/400 |
| 4,561,547 | A | * | 12/1985 | Estwanik, III | 211/14 |
| 4,953,817 | A | | 9/1990 | Mosteller | |
| D335,416 | S | | 5/1993 | Shaw | |
| 5,294,005 | A | | 3/1994 | Hedges | |
| D373,498 | S | | 9/1996 | Young | |
| D377,572 | S | | 1/1997 | Martin | |
| 5,626,244 | A | | 5/1997 | Mesna et al. | |
| 5,690,235 | A | | 11/1997 | Matzen | |
| 5,927,519 | A | * | 7/1999 | Koonts et al. | 211/85.7 |
| 6,029,830 | A | | 2/2000 | Manookian | |
| 6,749,074 | B1 | * | 6/2004 | Hileman et al. | 211/85.7 |
| D493,056 | S | * | 7/2004 | Shornak | D6/552 |
| 6,910,574 | B2 | * | 6/2005 | Straka | 206/315.1 |
| 6,948,627 | B1 | | 9/2005 | Evans | |
| 7,278,539 | B2 | * | 10/2007 | Souza | 206/315.1 |
| 7,559,423 | B2 | * | 7/2009 | Vosloo | 206/315.1 |
| 2006/0144806 | A1 | * | 7/2006 | Joannou, Jr. | 211/85.7 |
| 2006/0226321 | A1 | * | 10/2006 | Tracy | 248/301 |
| 2008/0277362 | A1 | * | 11/2008 | White | 211/85.7 |
| 2009/0134156 | A1 | * | 5/2009 | Hadar | 220/4.28 |
| 2009/0188819 | A1 | * | 7/2009 | Carney et al. | 206/315.1 |
| 2009/0283486 | A1 | * | 11/2009 | Reason-Kerkhoff | 211/85.7 |

* cited by examiner

*Primary Examiner*—Jennifer E. Novosad
(74) *Attorney, Agent, or Firm*—Crossley Patent Law; Mark A. Crossley

(57) ABSTRACT

The collapsible baseball equipment hanger apparatus is selectively folded for transport and unfolded for use in removably attaching to a fence or other object via the hooks provided at the top edge of the rear panel. The left side panel, right side panel, and rear panel pivot or fold inwardly to lie atop the base and each other, progressively. The collapsed apparatus thereby provides a relatively small size for transport. The base, with side panels folded out and up, is of sufficient size to hold a helmet therebetween. The drink holder can optionally include insulation for aiding in maintaining drink temperature, and the forwardly positioned container provides for best visual and manual access. The shamrock-shaped bat slot provides for individual access of up to three bats in a very compact area and at the front of the base for easiest access. Accessory hooks provide for removably holding various items.

20 Claims, 5 Drawing Sheets

COLLAPSIBLE BASEBALL EQUIPMENT HANGAR APPARATUS

BACKGROUND OF THE INVENTION

It is well known that baseball equipment, at the field especially, is typically in disorganized disarray. Balls, bats, gloves, hats are all subject continually to being mixed with those belonging to others, scattered, and lost. The problem is worsened in trying to identify which item belongs to whom, especially considering that typically at least a team of 9 players is involved and usually a team of many more than that. Additionally, keeping a drink upright or personalized is also difficult if not impossible. Keeping equipment off of the ground or dugout floor is desirable but seldom possible. Providing a portable solution faces problems, also. The present apparatus offers a selectively portable and collapsible solution to these problems.

FIELD OF THE INVENTION

The present invention relates specifically to baseball equipment storage devices and more especially to a collapsible baseball equipment hanger apparatus.

SUMMARY OF THE INVENTION

The general purpose of the collapsible baseball equipment hanger apparatus, described subsequently in greater detail, is to provide a collapsible baseball equipment hanger apparatus which has many novel features that result in an improved collapsible baseball equipment hanger apparatus which is not anticipated, rendered obvious, suggested, or even implied by prior art, either alone or in combination thereof.

To attain this, the collapsible baseball equipment hanger apparatus is folded for transport and unfolded for use in removably attaching to a fence or other object via the hooks provided at the top edge of the rear panel. The left side panel, right side panel, and rear panel pivot or fold inwardly, in that order, to lie atop the base and each other, progressively. The collapsed apparatus thereby provides a relatively small size for transport, with the optional carry case providing more convenience. The base, with side panels folded out and up, is of sufficient size to hold a helmet therebetween. The drink holder can optionally include insulation for aiding in maintaining drink temperature, and the forwardly positioned holder provides for best visual and manual access. Attaching the drink holder to the side elevation provides secure attachment and enables the folding of the sides as illustrated. The shamrock-shaped bat slot provides for individual access of up to three bats in a very compact area and at the front of the base for easiest access. Accessory hooks provide for removably holding various items. The base, rear panel, and side panels provide relatively large areas for personalization, logo location, for chosen advertising.

Thus has been broadly outlined the more important features of the improved collapsible baseball equipment hanger apparatus so that the detailed description thereof that follows may be better understood and in order that the present contribution to the art may be better appreciated.

An object of the baseball equipment storage apparatus is to be collapsible.

Another object of the baseball equipment storage apparatus is to removably fasten to an object.

An added object of the baseball equipment storage apparatus is to removably hold bats and other baseball related equipment, including a helmet.

It is a further object of the baseball equipment storage apparatus to provide surfaces conducive to labeling and advertising.

And, an object of the baseball equipment storage apparatus to hold more than one bat.

Yet another object of the collapsible baseball equipment hanger apparatus is to be conducive to transport in a small carry case.

These together with additional objects, features and advantages of the improved collapsible baseball equipment hanger apparatus will be readily apparent to those of ordinary skill in the art upon reading the following detailed description of presently preferred, but nonetheless illustrative, embodiments of the improved collapsible baseball equipment hanger apparatus when taken in conjunction with the accompanying drawings.

In this respect, before explaining the current embodiments of the improved collapsible baseball equipment hanger apparatus in detail, it is to be understood that the collapsible baseball equipment hanger apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved collapsible baseball equipment hanger apparatus. It is therefore important that the claims be regarded as including such equivalent constructions insofar as they do not depart from the spirit and scope of the collapsible baseball equipment hanger apparatus. It is also to be understood that the phraseology and terminology employed herein are for purposes of description and should not be regarded as limiting.

BRIEF DESCRIPTION OF THE DRAWINGS

FIG. 4 is a front elevation view of the apparatus, left side panel partially folded in.

FIG. 5 is a front elevation view of the apparatus, left side panel folded in, right side panel partially folded in.

FIG. 6 is a left side elevation view of the apparatus, left side panel folded in, right side panel folded in, rear panel partially folded in.

DETAILED DESCRIPTION OF THE DRAWINGS

With reference now to the drawings, and in particular FIGS. 1 through 8 thereof, the principles and concepts of the collapsible baseball equipment hanger apparatus generally designated by the reference number 10 will be described.

Figure 1:
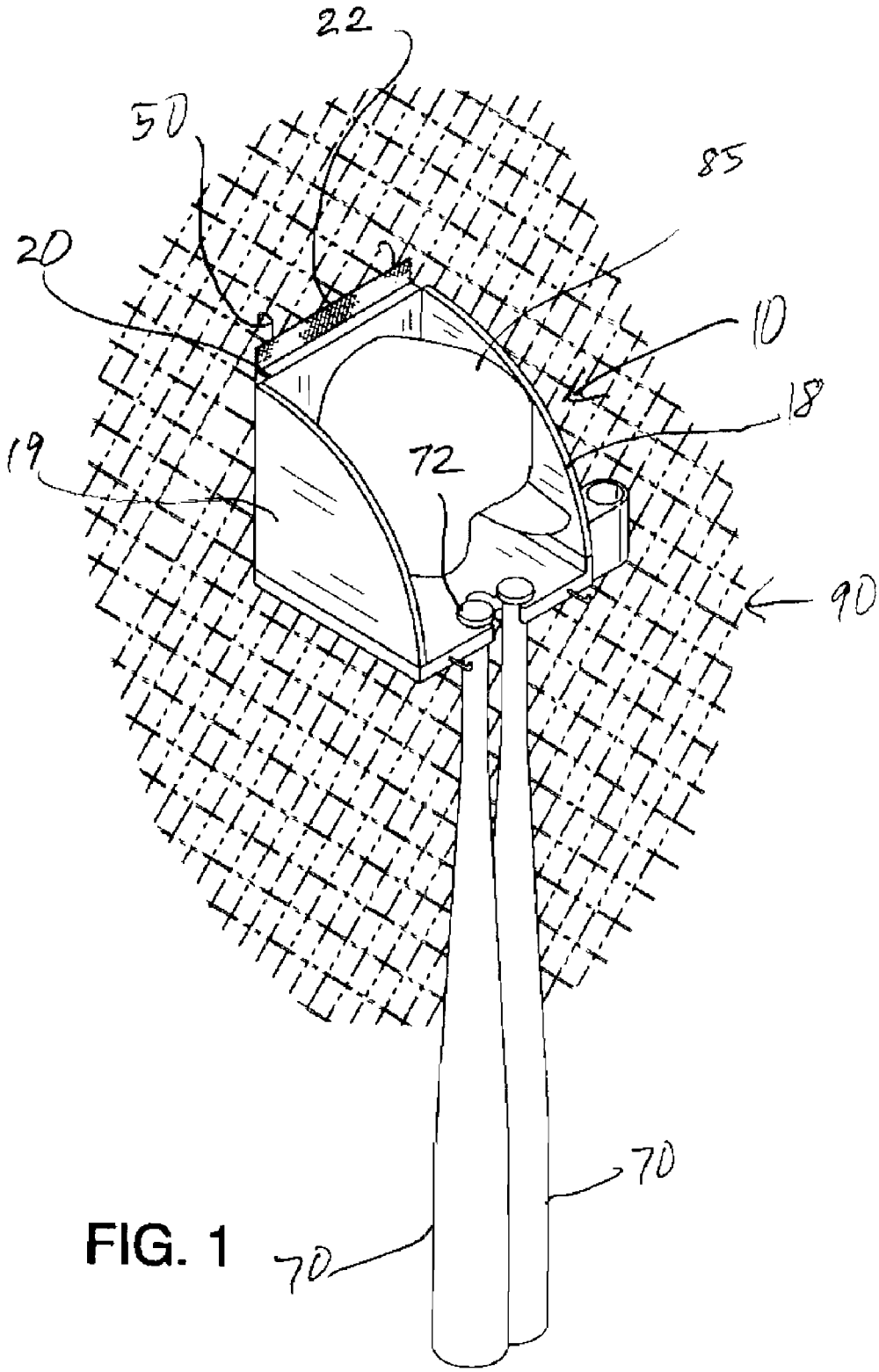
FIG. 1 is a perspective view of the apparatus in use and hung on a fence.
Figure 2:
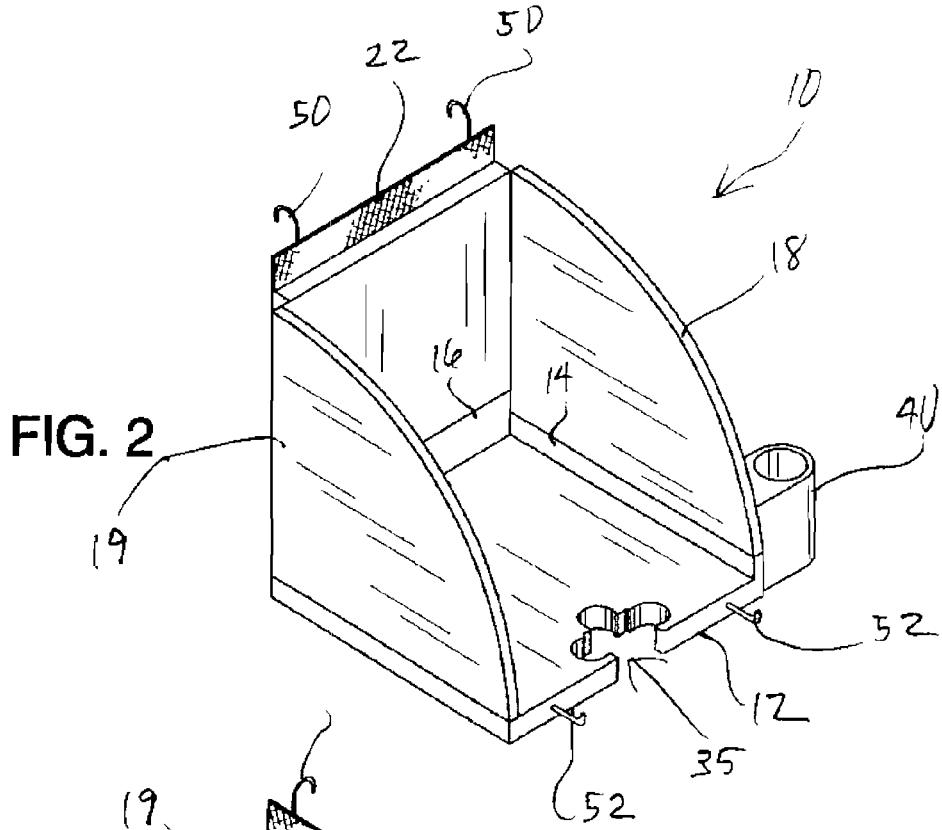
FIG. 2 is a left side perspective view if the apparatus in unfolded state.
Figure 3:
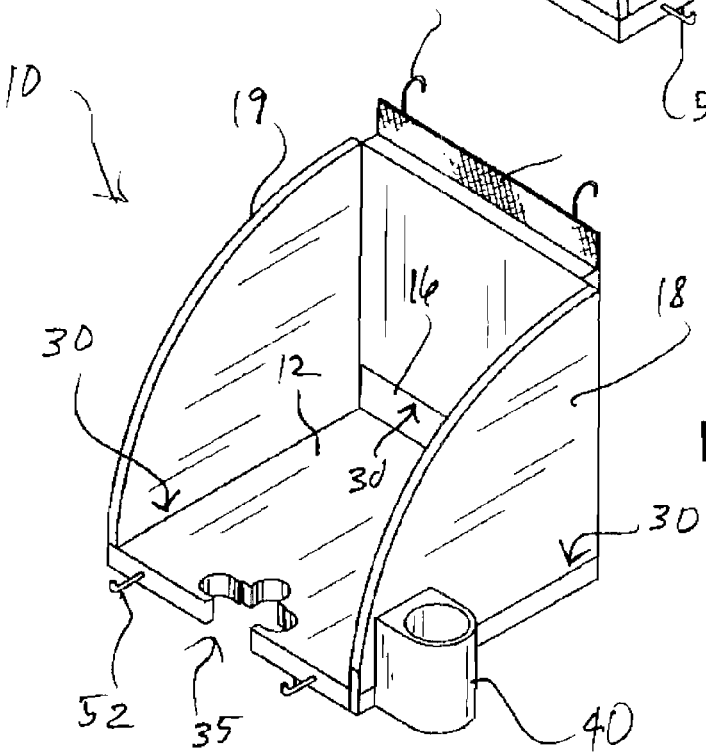
FIG. 3 is right side perspective view of the apparatus in unfolded state.
Figure 4:
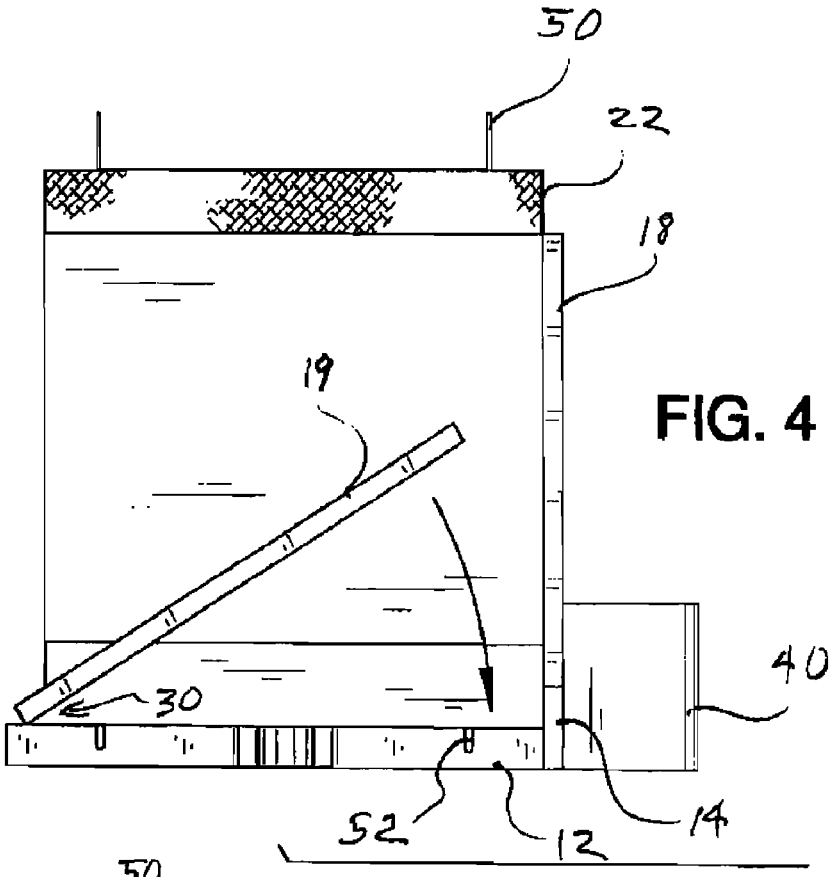
Figure 5:
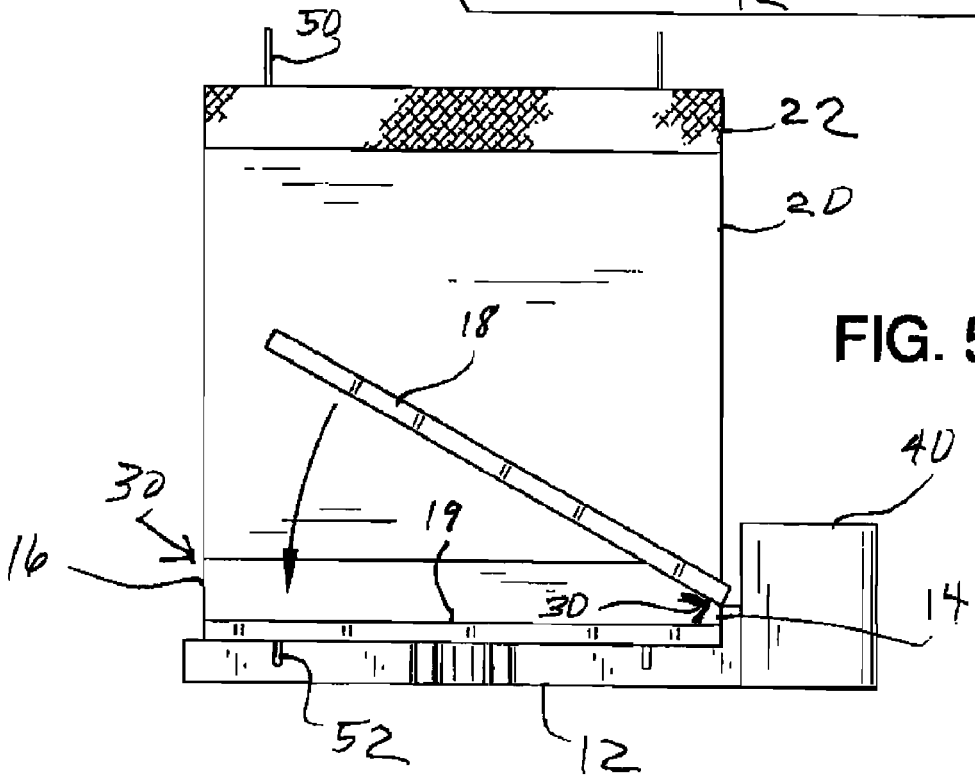
Figure 6:
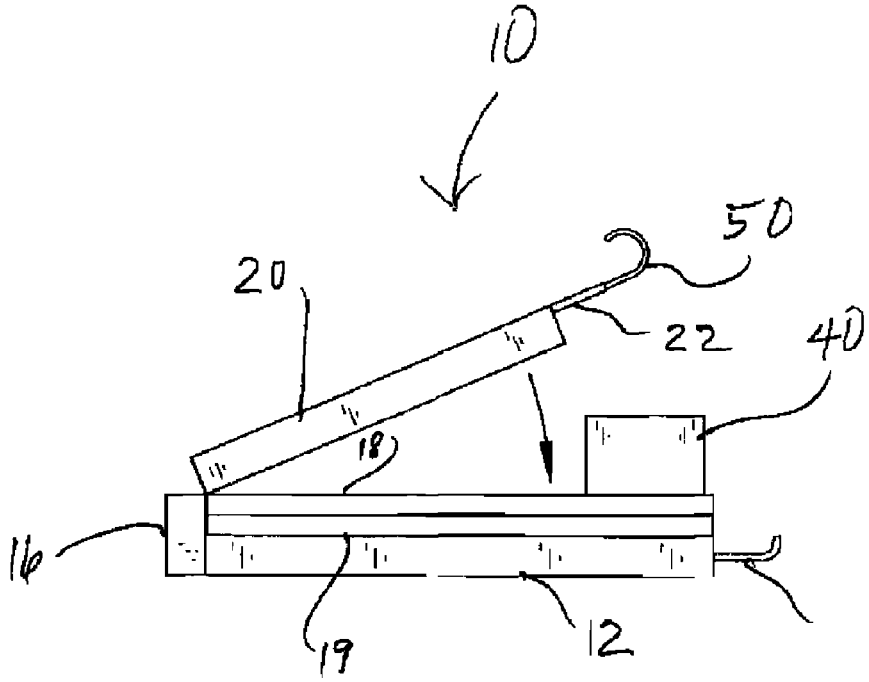
Figure 7:
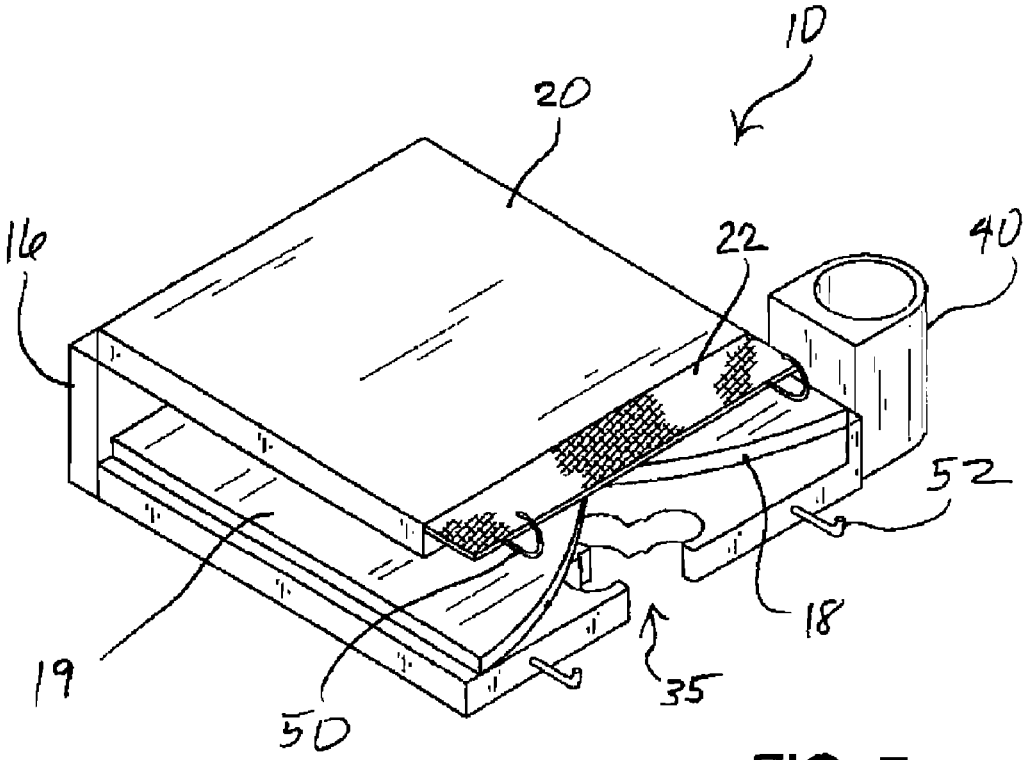
FIG. 7 is a perspective view of the apparatus completely folded in upon itself.

Referring to FIG. 1, the collapsible equipment hanger apparatus 10 is provided for hooking to an object such as a chain link fence 90. In the unfolded state, wherein the rear panel 20 and right side panel 18 and left side panel 19 are pivoted to an unfolded state. The apparatus 10 provides for hooking on a chain link fence 90 via the hanging hooks 50, with the flexible strip 22 providing for selectively locating the hooks 50 somewhat, so that other fences 90 or varying objects are more easily accommodated. The accessory hooks 52 provide for holding various accessories which may include baseball gloves or other items.

Referring to FIGS. 2-7, the apparatus 10 comprises a rectangular base 12. Two spaced apart hanging hooks 50 are extended from the front of the base 12. The bat slot 35 comprises a shamrock-shaped opening in the front of the base 12. The shamrock-shaped opening of the slot 35 provides for 3 bats 70 to be removably held within the slot 35 by the bat knob 72 of each bat 70. Lifting of any of the three bats 70 allows a user to individually remove or add that bat 70 without disturbing the other bats 70. The side elevation 14 is affixed to a right side of the base 12. The side elevation has a height greater than the height of the base 12. The rear elevation 16 is affixed to the rear of the base 12. The rear elevation 16 has a height greater than the height of the side elevation 14. The rear panel 20 is hingedly affixed to the rear elevation 16. Hinges of the apparatus 10 are not shown and can be comprised of any of a variety of hinges available and known in the mechanical arts. The rear panel 20 is therefore capable of being vertical or pivoted to a position coplanar to the base 12. The right side panel 18 is hingedly affixed to the side elevation 14. The right side panel 18 has a rounded upper edge. A right angle formed by a back edge and a bottom edge of the right side panel 18. The right side panel 18 has the capability of being vertical or pivoted to a position coplanar to the base 12. The left side panel 19 is hingedly affixed to the left side of the base 12. The left side panel 19 has a height greater than the right side panel 18 height. The left side panel 19 has a rounded upper edge. A right angle is formed by the back edge and the bottom edge of the left side panel 19. The left side panel 19 has the capability of being vertical or pivoted to a position coplanar to the base 12 and therefore simultaneously atop the right side panel 18 when the right side panel 18 is pivoted into the downward, folded position. Due to the unequal heights of the left side panel 19 and right side panel 18, and the side elevation 14, the rounded edge of the left side panel 19 and the right side panel 18 are at equal height when vertical. The drink holder 40 is affixed to the side elevation 14, as the side elevation 14 provides a larger surface than an outer edge of the base 12 might. The forward location of the drink holder 40 provides for best visual and manual accessibility of any drink held in the drink holder 40.

Figure 8:
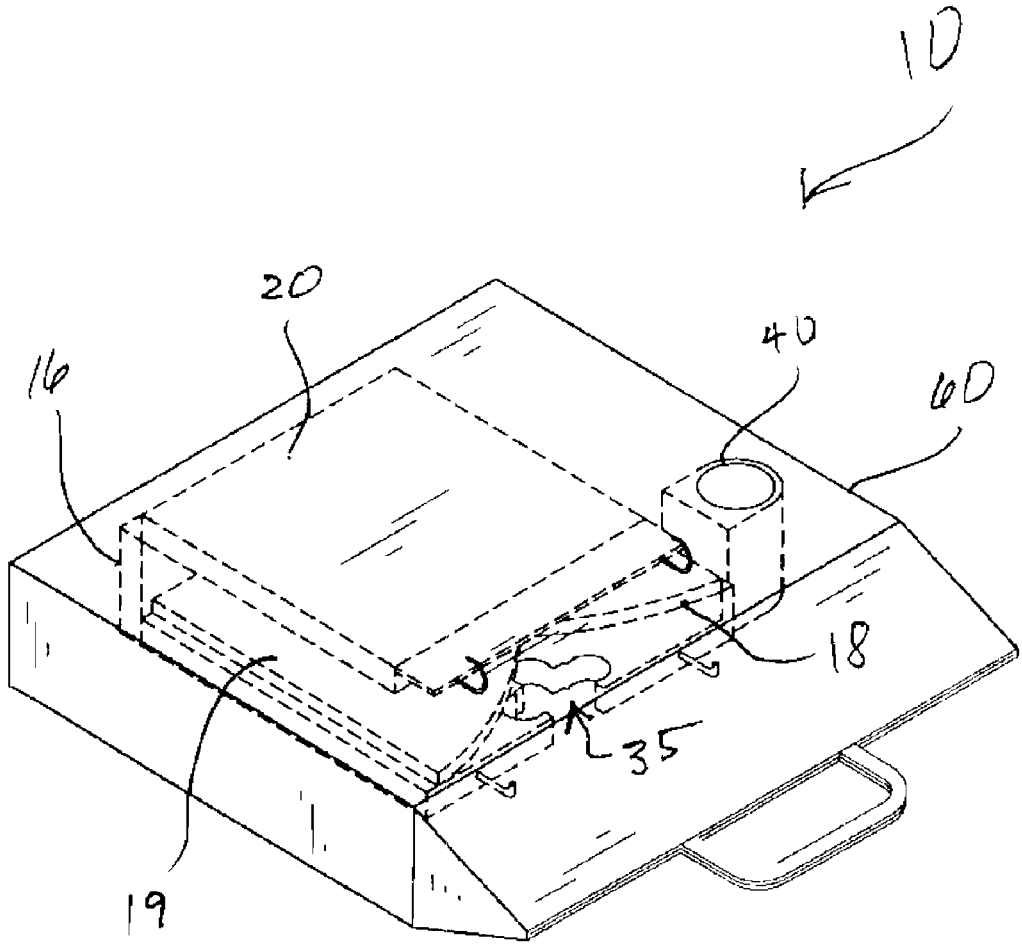
FIG. 8 is a perspective view of the apparatus folded in upon itself and housed in the optional carry case.

Referring to FIG. 8, the carry case 60 is optionally provided. The collapsible or folding capability of the apparatus 10 provides for fit into the compact carry case. The overall height of the apparatus 10 in the folded state provides that the downwardly pivoted rear panel 20 is of the same height as the top of the drink holder 40.

With respect to the above description then, it is to be realized that the optimum dimensional relationships for the parts of the collapsible baseball equipment hanger apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the collapsible baseball equipment hanger apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the collapsible baseball equipment hanger apparatus may be used.

Therefore, the foregoing is considered as illustrative only of the principles of the collapsible baseball equipment hanger apparatus. Further, since numerous modifications and changes will readily occur to those skilled in the art, it is not desired to limit the collapsible baseball equipment hanger apparatus to the exact construction and operation shown and described, and accordingly, all suitable modifications and equivalents may be resorted to, falling within the scope of the collapsible baseball equipment hanger apparatus.

What is claimed is:

1. A collapsible equipment hanger apparatus, comprising:

a rectangular base;

at least one accessory hook extended from a front of the base;

a bat slot in the front of the base, the bat slot capable of removably holding at least one bat;

a side elevation affixed to a right side of the base, the side elevation having a height greater than a height of the base;

a rear elevation affixed to a rear of the base, the rear elevation having a height greater than the height of the side elevation;

a rear panel hingedly affixed to the rear elevation, the rear panel capable of being vertical or pivoted to a position coplanar to the base;

a right side panel hingedly affixed to the side elevation, a right angle formed by a back edge and a bottom edge of the right side panel, the right side panel capable of being vertical or pivoted to a position coplanar to the base;

a left side panel hingedly affixed to a left side of the base, the left side panel of a height greater than the right side panel, a right angle formed by a back edge and a bottom edge of the left side panel, the left side panel capable of being vertical or pivoted to a position coplanar to the base and simultaneously atop the pivotally coplanar right side panel;

means for removably attaching the apparatus to an object.

2. The apparatus according to claim 1 wherein the means for removably attaching further comprises a flexible extension affixed to a top of the rear panel, the flexible extension having at least one hook for engaging the object.

3. The apparatus according to claim 2 wherein the bat slot further comprises a shamrock-shaped bat slot, the shamrock-shaped slot capable of removably holding up to three bats.

4. The apparatus according to claim 3 wherein a drink holder is affixed to the side elevation.

5. The apparatus according to claim 4 wherein the drink holder is affixed proximal to a front of the side elevation.

6. The apparatus according to claim 2 wherein a drink holder is affixed to the side elevation.

7. The apparatus according to claim 6 wherein the drink holder is affixed proximal to a front of the side elevation.

8. The apparatus according to claim 1 wherein the bat slot further comprises a shamrock-shaped bat slot, the shamrock-shaped slot capable of removably holding up to three bats.

9. The apparatus according to claim 8 wherein a drink holder is affixed to the side elevation.

10. The apparatus according to claim 9 wherein the drink holder is affixed proximal to a front of the side elevation.

11. The apparatus according to claim 1 wherein a drink holder is affixed to the side elevation.

12. The apparatus according to claim 11 wherein the drink holder is affixed proximal to a front of the side elevation.

13. A collapsible equipment hanger apparatus, comprising:

a rectangular base;

at least one accessory hook extended from a front of the base;

a bat slot in the front of the base, the slot capable of removably holding at least one bat;

a side elevation affixed to a right side of the base, the side elevation having a height greater than a height of the base;

a rear elevation affixed to a rear of the base, the rear elevation having a height greater than the height of the side elevation;

a rear panel hingedly affixed to the rear elevation, the rear panel capable of being vertical or pivoted to a position coplanar to the base;

a flexible extension affixed to a top of the rear panel, the flexible extension having at least one hook for engaging an object;

a right side panel hingedly affixed to the side elevation, the right side panel having a rounded upper edge, a right angle formed by a back edge and a bottom edge of the right side panel, the right side panel capable of being vertical or pivoted to a position coplanar to the base;

a left side panel hingedly affixed to a left side of the base, the left side panel of a height greater than the right side panel, the left side panel having a rounded upper edge, a right angle formed by a back edge and a bottom edge of the left side panel, the left side panel capable of being vertical or pivoted to a position coplanar to the base and simultaneously atop the right side panel.

14. The apparatus according to claim 13 wherein a drink holder is affixed to the side elevation.

15. The apparatus according to claim 14 wherein the drink holder is affixed proximal to a front of the side elevation.

16. A collapsible equipment hanger apparatus, comprising:

a rectangular base;

at least one accessory hook extended from a front of the base;

a bat slot in the front of the base;

a side elevation affixed to a right side of the base, the side elevation having a height greater than a height of the base;

a rear elevation affixed to a rear of the base, the rear elevation having a height greater than the height of the side elevation;

a rear panel hingedly affixed to the rear elevation, the rear panel capable of being vertical or pivoted to a position coplanar to the base;

a flexible extension affixed to a top of the rear panel, the flexible extension having at least one hook for engaging an object;

a right side panel hingedly affixed to the side elevation, the right side panel having a rounded upper edge, a right angle formed by a back edge and a bottom edge of the right side panel, the right side panel having a capability of being vertical or pivoted to a position coplanar to the base;

a left side panel hingedly affixed to a left side of the base, the left side panel of a height greater than the right side panel, the left side panel having a rounded upper edge, a right angle formed by a back edge and a bottom edge of the left side panel, the left side panel capable of being vertical or pivoted to a position coplanar to the base and simultaneously atop the right side panel, the rounded edge of the left side panel and the right side panel of equal height when vertical.

17. The apparatus according to claim 16 wherein the bat slot further comprises a shamrock-shaped bat slot, the shamrock-shaped slot capable of removably holding up to three bats.

18. The apparatus according to claim 17 further comprising a drink holder affixed to the side elevation.

19. The apparatus according to claim 18 wherein the drink holder is further disposed proximal to a front of the side elevation.

20. The apparatus according to claim 19 further comprising a carry case for carrying the apparatus in a folded state.

* * * * *